US011845651B2

(12) United States Patent
Vanderbeken et al.

(10) Patent No.: US 11,845,651 B2
(45) Date of Patent: Dec. 19, 2023

(54) SPOOL OF POCKETED SPRINGS

(71) Applicant: NV BEKAERT SA, Zwevegem (BE)

(72) Inventors: Bert Vanderbeken, Waregem (BE); Nico Vermandele, Tielt (BE); Wim Desmet, Moorslede (BE); Maarten Meyfroidt, Oostrozebeke (BE)

(73) Assignee: NV BEKAERT SA, Zwevegem (BE)

( * ) Notice: Subject to any disclaimer, the term of this patent is extended or adjusted under 35 U.S.C. 154(b) by 0 days.

(21) Appl. No.: 17/608,282

(22) PCT Filed: Mar. 26, 2020

(86) PCT No.: PCT/EP2020/058457
§ 371 (c)(1),
(2) Date: Nov. 2, 2021

(87) PCT Pub. No.: WO2020/229036
PCT Pub. Date: Nov. 19, 2020

(65) Prior Publication Data

US 2022/0212915 A1 Jul. 7, 2022

(30) Foreign Application Priority Data

May 14, 2019 (EP) ..... 19174378

(51) Int. Cl.
*B68G 9/00* (2006.01)

(52) U.S. Cl.
CPC ..... *B68G 9/00* (2013.01)

(58) Field of Classification Search
CPC ..... F16F 3/02; F16F 3/04; F16F 1/02; F16F 1/04; B68G 9/00
See application file for complete search history.

(56) References Cited

U.S. PATENT DOCUMENTS 1,602,197 A * 10/1926 Le ..... A47C 27/064 5/655.8
3,437,197 A * 4/1969 Wirfel ..... B65D 85/07 206/83.5

(Continued)

FOREIGN PATENT DOCUMENTS

EP 0 624 545 11/1994
WO 2019/046892 3/2019

OTHER PUBLICATIONS

International Search Report and Written Opinion of the International Searching Authority dated Apr. 22, 2020, in International (PCT) Application No. PCT/EP2020/058457.

*Primary Examiner* — Moshe Wilensky
*Assistant Examiner* — Darrell C Ford
(74) *Attorney, Agent, or Firm* — Wenderoth, Lind & Ponack, L.L.P.

(57) ABSTRACT

A spool (100) of a linear string (110, 210, 310, 410) of pocketed springs is disclosed. The linear string of pocketed springs comprises springs (212, 312, 412) each provided in a textile pocket (214, 314, 414). The springs (212, 312, 412) comprise helically coiled steel wire springs. The textile pockets (214, 314, 414) are assembled to each other in linear direction. The linear string (110, 210, 310, 410) has a width of one textile pocket (214, 314, 414). The string (110, 210, 310, 410) of pocketed springs is present in the spool (100) spirally wound and in a compressed state such that the pocketed springs (212, 312, 412) can expand upon unwinding the string (110, 210, 310, 410) of pocketed springs from the spool (100).

14 Claims, 2 Drawing Sheets

(56) References Cited

U.S. PATENT DOCUMENTS

| | | | | |
|---|---|---|---|---|
| 4,406,391 | A | 9/1983 | St. Clair | |
| 5,537,699 | A * | 7/1996 | Bonaddio | A47C 27/063 5/717 |
| 5,613,287 | A | 3/1997 | St. Clair | |
| 6,175,997 | B1 * | 1/2001 | Mossbeck | A47C 27/064 29/896.92 |
| 8,443,974 | B2 * | 5/2013 | Oh | B65B 25/146 206/394 |
| 2005/0257323 | A1 * | 11/2005 | Edling | A47C 27/064 5/716 |
| 2007/0204566 | A1 * | 9/2007 | Lee | B65D 85/07 53/436 |
| 2011/0265266 | A1 * | 11/2011 | Mantzis | A47C 27/062 5/720 |
| 2016/0304231 | A1 * | 10/2016 | Corodemus | B65B 5/045 |
| 2016/0304292 | A1 * | 10/2016 | Fowler | B68G 15/00 |
| 2017/0303696 | A1 * | 10/2017 | Sherman | A47C 27/064 |
| 2018/0057200 | A1 * | 3/2018 | Lawrie | A47C 27/00 |
| 2019/0023440 | A1 * | 1/2019 | Oh | B65B 63/04 |
| 2019/0380503 | A1 * | 12/2019 | Stjerna | A47C 7/347 |
| 2020/0178697 | A1 * | 6/2020 | Mantzis | B65B 63/02 |

* cited by examiner

SPOOL OF POCKETED SPRINGS

TECHNICAL FIELD

The invention relates to the field of pocketed spring cores as are used in mattresses or in cushions such as used in sofas. The invention relates to the provision of a spool of a linear string of such pocketed springs; and to a method to make such a spool. The invention further relates to a method to make a pocketed spring core using spools of a linear spring of pocketed springs; and to an apparatus for assembling linear strings of pocketed springs into a two-dimensional spring core.

BACKGROUND ART

Pocketed spring cores for mattresses or cushions are well known. The cores comprise a two-dimensional array of helically wound springs each provided in a pocket made from textile fabric. Such cores are made by assembling parallel to each other linear strings of pocketed springs cut to appropriate length. The assembly can be performed by means of an appropriate adhesive. Most of time the textile fabric out of which the pockets are made is a textile nonwoven, e.g. a spunbonded fabric. Use of a spunbonded fabric enables that the pockets can be made by means of thermal welding.

U.S. Pat. No. 5,613,287 discloses a method for forming strings of pocketed springs. The springs are first inserted in compressed state in the pockets in such a way that the height direction of the spring is perpendicular to the height direction of the pocket, after which the spring is turned over 90° such that the spring expands and such that the height direction of the spring coincides with the height direction of the pocket.

In a known method, pocketed spring core manufacturing is performed in line with the production of the strings of pocketed springs. An intermediate bin is provided as intermediate storage of the strings of pocketed springs. U.S. Pat. No. 4,406,391 provides an example of such approach. Alternatively, the processes of production of strings of pocketed springs and the assembly of the pocketed springs to build a pocketed spring mattress core are separated. The strings of pocketed springs are stored in bins after their manufacture. The bins are then transported in due time to the assembly line where the two-dimensional pocketed spring mattress core is assembled using the linear strings of pocketed springs taken from the bin or bins.

There is a growing tendency to produce pocketed spring cores with strings of different characteristics. Such technology allows manufacturing mattresses with zones with different spring properties in order to improve mattress comfort. EP0624545A1 gives an example of a method to produce such pocketed spring cores using strings with different resiliency and/or different damping characteristics.

A number of trends in mattress industry and in consumer preferences require improvements to the production processes of pocketed spring mattress cores. There is a growing tendency to individualization of mattresses, e.g. mattresses with different compression zones specifically designed to individual needs. This trend strongly increases the different types of mattress cores that need to be produced, requiring more versatility and flexibility in the production processes. Speeds of spring coiling are increasing, causing constraints to in-line processes as all steps of a manufacturing process must be able to follow the higher spring coiling speeds. The different technological skill requirements in manufacturing the strings of pocketed springs (involving spring coiling and insertion in a textile pocket) and in core assembly provide further arguments for splitting the manufacture of strings of pocketed springs from the their assembly in mattress cores. The trends mentioned already involve increased intermediate storage of strings of pocketed springs. All these trends ask for a new approach and cost optimization of the manufacturing process of pocketed spring cores.

DISCLOSURE OF INVENTION

The first aspect of the invention is a spool of a linear string of pocketed springs. The linear string of pocketed springs comprises springs each provided in a textile pocket. The springs comprise—and preferably consist out of—helically coiled steel wire springs. The textile pockets are assembled to each other in linear direction. The linear string has a width of one textile pocket. The string of pocketed springs is present in the spool spirally wound and in a compressed state such that the pocketed springs can expand upon unwinding the string of pocketed springs from the spool.

The invention provides a compact way of storing and transporting linear strings of pocketed springs. As the strings and the pocketed springs are in a compressed state in the spool, less volume is taken compared by the prior art way of storing and transporting the linear strings in bins. Storing the linear string of pocketed springs in compressed state has the further advantage that the pocketed springs will show less permanent deformation when used in a mattress core, as keeping the pocketed springs in a compressed state on the spool already takes away at least part of the relaxation of the springs.

Upon unwinding the linear string of pocketed springs from the spool, the pocketed springs can be allowed to relax to uncompressed state in order to be assembled into a two-dimensional pocketed spring core.

Spools with pocketed springs with different characteristics can be used to assemble a two-dimensional pocketed spring core having zones with different spring properties. Such approach reduces the warehouse area required to store the strings of pocketed springs; and provides versatility and flexibility in mattress core manufacturing.

Preferably, the pockets are made from spunbonded nonwoven fabric by means of welds, more preferably by means of thermal welds.

Preferably, the linear string of pocketed springs is present as a multitude of layers in radial direction of the spool.

In a preferred embodiment, an interlayer material (e.g. paper, paperboard, a tape or a textile fabric) is provided between the layers. It is a benefit of such embodiment that the interlayer material can help to compress the pocketed springs during winding and to keep the pocketed springs in compressed state on the spool. The interlayer material also facilitates unwinding of the spool as entanglements between layers on the spool are effectively prevented.

In a preferred alternative embodiment, successive layers of the linear string of pocketed springs make direct contact. Such approach is cost effective and reduces waste as no interlayer material is present between successive layers of the linear string of pocketed springs; interlayer material which would need to be discarded upon unwinding the spool.

Preferably, a multitude of pockets are provided next to each other in longitudinal direction of the spool axis.

In a preferred spool, the linear string of pocketed springs is wound in alternating first and second layers over the width direction of the spool. After winding the string of pocketed springs in a first layer in a first width direction of the spool, the string of pocketed springs is wound in a second layer in the direction opposite to the first width direction over the width of the spool. Such embodiments have the benefits that space is used in a very economical way and that unwinding the spool can be performed in an easy way, minimizing the risk of unwinding problems which could occur due to entanglements of the string of pocketed springs on the spool. In a more preferred such embodiment the winding is performed with minimum space, but without overlap, between adjacent pockets in a layer.

In an alternative embodiment wherein the linear string of pocketed springs is present as a multitude of layers in radial direction of the spool, each layer has a width in longitudinal direction of the spool axis of only one pocketed spring. More preferably, such spool has a core on which the linear string of pocketed springs is wound and one—and more preferably two—flange(s).

In a preferred spool, the pockets have a height direction perpendicular to the length direction of the string of pocketed springs. The springs are provided in the pockets such that the height direction of the helically coiled steel wire spring is perpendicular to the height direction of the pockets. The height direction of the pockets is the direction that will provide the thickness of the 2D-core made with the string of pocketed springs. Such embodiments have the benefit that as the springs are present in the pockets in a position 90° turned with respect to their final position in the 2D-spring core, the geometric constraint in the pocket creates a compression of the helical spring, facilitating the winding of the string of pocketed springs in compressed state into the spool. Upon unwinding the string from the spool, the helical spring can easily be turned to its final position in which the height direction of the helical spring coincides with the height direction of the pocket; which is also the thickness direction of the 2D-core made with the linear string of pocketed springs. Such embodiment has a further benefit. A common type of machines used to manufacture linear strings of pocketed springs manufactures the pocketed spring such that the helically coiled steel wire springs are inserted in the pockets with their height direction perpendicular to the height direction of the pockets. After sealing the pockets, the springs are turned in the pockets for the height direction of the spring to coincide with the height direction of the pocket. This turning on the string manufacturing machine is not required when making a spool according to this embodiment of the invention.

In an alternative preferred embodiment, the pockets have a height direction perpendicular to the length direction of the string of pocketed springs; and the springs are provided in the pockets such that the height direction of the springs coincides with the height direction of the pockets.

In a preferred embodiment, the linear string of pocketed springs in the spool comprises pockets in a first arrangement and pockets in a second arrangement. The pockets in the second arrangement differ from the pockets of the first arrangement in that the pockets have been turned around the length direction of the string over 180° or over a multiple of 180°. More preferably, pockets according to the first arrangement alternate in the spool with pockets of the second arrangement along the length of the linear string of pocketed springs. The transition in the string of pocketed springs from a pocket of the first arrangement to a pocket of the second arrangement can be easily noticed via the rotation at the connection of the pockets: this connection has been turned over 180° or over a multiple of 180° degrees. The rotation of the pockets can be performed when winding the string of pocketed springs on the spool. The rotation can be removed again when unwinding the string of pocketed springs from the spool. Such embodiments have the benefit that upon rotation of a pocket relative to the preceding pocket in the linear string, the fabric out of which the pocket is made compresses the springs in the pockets. Therefore, winding the pockets in a compressed state onto the spool is facilitated and the compressed state of the pockets is more easily maintained on the spool.

In a preferred spool according to any embodiment of the first aspect of the invention, the last wound part of the linear string is fixed in the spool such that the compressing tension on the pockets is maintained. The fixation can be done on a length of the linear spring previously wound, or on a part of a spool carrier when the spool comprises a spool carrier. Such a spool carrier can be a core, or can be a core with one or two lateral flanges.

Preferably, the height direction of the pockets is provided in radial direction of the spool. In such embodiments, the winding tension when winding the spool helps to compress the pocketed springs. Alternatively however, the height direction of the pockets can be provided in axial direction of the spool.

In an embodiment of the first aspect of the invention, the spool comprises a core. The linear string of pocketed springs is wound around the core. The core can e.g. be a cardboard core; e.g. a tube out of cardboard. More preferably, the linear string of pocketed springs is fixed to the core at the start of winding the linear pocketed spring to the core.

Alternatively, the spool can be provided without having a core. Such spool can be made e.g. by winding the string of pocketed spring around a core, and removing the core after winding the spool. For unwinding such a spool, it is e.g. possible to insert a shaft or a core at the centre of the coreless spool.

In preferred embodiments of the first aspect of the invention, a fabric tape is glued on top of and/or at the bottom of the string of pocketed springs. It is a benefit of such embodiments that entanglements between layers of the string of pocketed springs are prevented; and that a cushioning or protection layer is provided for the pocketed spring core that will be made using the spool of pocketed springs. This cushioning or protection layer can replace a fabric layer traditionally applied at the top and/or at the bottom of two-dimensional pocketed spring core. The fabric tape can e.g. be a nonwoven tape; preferably a nonwoven tape having a certain degree of bulk. It is also possible that the tape has a multiple number of layers. Gluing the fabric tape on top of and/or at the bottom of the string of pocketed springs can be performed before or during winding the pocketed springs on the spool. Preferably, the tape has the width of the string of pocketed spring in uncompressed condition.

The second aspect of the invention is an apparatus for winding a string of pocketed springs into a spool of pocketed springs as in any embodiment of the first aspect of the invention. The apparatus comprises a compression device for compressing the pocketed springs while being wound into the spool. Preferably the apparatus comprises a compression unit for compressing the pockets prior to the string of pocketed springs reaching the point of winding the string into the spool.

In a preferred apparatus for winding a string of pocketed springs into a spool of pocketed spring, the compression device is one or a plurality of rollers; or the compression device is an endless belt enveloping part of the surface of the spool while being wound.

The third aspect of the invention is a method of manufacturing a spool of a linear string of pocketed springs as in any embodiment of the first aspect of the invention. The method comprises the steps of providing a linear string of pocketed springs; and winding a spool as in the first aspect of the invention using an apparatus as in any embodiment of the second aspect of the invention.

The fourth aspect of the invention is a method of manufacturing a two-dimensional pocketed spring core, e.g. for a mattress or for a cushion e.g. for a seating product. The method comprises the steps of providing a spool of a linear string of pocketed springs as in any embodiment of the first aspect of the invention; unwinding the linear string of pocketed springs from the spool and allowing the pocketed springs to relax to their uncompressed state; and assembling the linear string of pocketed springs into a two-dimensional pocketed spring core. Preferably, the assembling is performed by gluing lengths of strings of pocketed springs parallel to each other.

A preferred method according to the fourth aspect of the invention comprises the steps of providing a plurality of spools of a linear string of pocketed springs as in any embodiment of the first aspect of the invention; unwinding the linear strings of pocketed springs from the spools and allowing the pocketed springs to relax to their uncompressed state; and assembling the linear strings of pocketed springs into a two-dimensional pocketed spring core. Preferably the pocketed springs of at least two of the plurality of spools of a linear string of pocketed springs differ in spring characteristics; e.g. in spring geometry and/or in spring stiffness. In a preferred such embodiment, a two-dimensional pocketed spring core is manufactured having zones with different spring characteristics; e.g. zones with different stiffness properties.

A preferred method according to any embodiment of the fourth aspect of the invention comprises the steps of providing one or a plurality of spools of a linear string of pocketed springs as in any embodiment of the first aspect of the invention; providing one or a plurality of machines for manufacturing strings of pocketed springs; unwinding linear string(s) from one or from more than one of the one or a plurality of spool allowing the pocketed springs to relax to their uncompressed state; and assembling into a two- dimensional spring core the unwound linear string(s) together with one or more strings of pocketed springs produced in-line with the assembly process on the one or a plurality of machines. This embodiment has the advantage that spring cores with springs having different characteristics can be made in a very efficient way. The one or a plurality of machines for manufacturing strings of pocketed springs can be set to make the type(s) of pocketed springs that are used in all or almost all spring cores that are to be made and thus that are required in large volumes and which are almost continuously required. The spools can contain strings of pocketed springs with characteristics that are more seldom used and/or used in small quantities. This way, spring cores of different designs and characteristics can be made with higher efficiency of the assembly process. It is faster, easier and cheaper to change over from spool to spool than it is to change over the type of pocketed springs made in a pocketed spring manufacturing machine. In a multi-spool set-up, the change-over from spool to spool can even be automated. In a more preferred embodiment, the change-over is electronically controlled.

In a preferred embodiment of the fourth aspect of the invention, an electronic control unit is provided for selecting and feeding the strings of pocketed springs to the assembly process.

The fifth aspect of the invention is an apparatus for the assembly of a two-dimensional pocketed spring core. The apparatus comprises one or a plurality of pay-of stands; one or a plurality of machines for manufacturing strings of pocketed springs; and an assembly station. The one or a plurality of pay-off stands are provided for holding each a spool of a linear string of pocketed springs as in any embodiment of the first aspect of the invention. The assembly station is provided for assembling in the two-dimensional spring core lengths of strings of pocketed springs unwound from the spool(s) on the one or a plurality of pay-off stands while allowing the pocketed springs to relax to their uncompressed state; and lengths of strings of pocketed springs produced inline by the one or plurality of machines. Preferably, the apparatus comprises an applicator for applying glue to at least one side surface of the strings of pocketed springs in order to glue lengths of strings of pocketed springs parallel to each other in the assembly of the two-dimensional pocketed spring core.

A preferred apparatus comprises a buffer—e.g. a bin—for temporarily buffering length of strings of pocketed springs produced by the pocketed spring manufacturing machine. This way, the machine can continuously manufacture pocketed springs even if the assembly station does not continuously consume strings of pocketed springs made by the manufacturing machine.

A preferred apparatus according to the fifth aspect of the invention comprises a control unit for controlling the feeding of the strings of pocketed springs from the spool and/or from the machines to the assembly station.

BRIEF DESCRIPTION OF THE FIGURES IN THE DRAWINGS

MODE(S) FOR CARRYING OUT THE INVENTION

Figure 1:
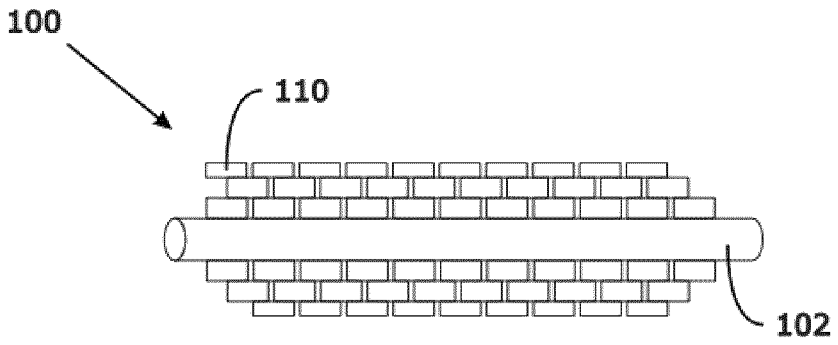
FIG. 1 shows—according to the invention—a spool of a linear string of pocketed springs.

FIG. 1 shows an exemplary spool 100 of a linear string of pocketed springs according to the first aspect of the invention. The exemplary spool comprises a core 102 and a linear string 110 of pocketed springs. The string 110 of pocketed springs is present in the spool spirally wound and in a compressed state such that the pocketed springs can expand upon unwinding the string of pocketed springs from the spool. The linear string 110 of pocketed springs is wound in multiple layers in radial direction of the spool. The linear string 110 of pocketed springs is wound in alternating first and second layers over the width direction of the spool. After winding the string of pocketed springs in a first layer in a first width direction of the spool, the string of pocketed springs is wound in a second layer in the direction opposite to the first width direction over the width of the spool. In the example, successive layers of the linear string of pocketed springs make direct contact. However, it is also possible (not shown in FIG. 1) to provide an interlayer material (e.g. paper, paperboard, a tape or a textile fabric) between the layers. The core can e.g. be a tube of paperboard. The linear string of pocketed springs can be fixed to the core at the start of winding the linear pocketed spring to the core. The last wound part of the linear string can be fixed in the spool such that the compressing tension on the pockets is maintained. The fixation can be done on a length of the linear spring previously wound, or on the paperboard core. The example of FIG. 1 shows the height direction of the pockets in radial direction of the spool.

Figure 2:
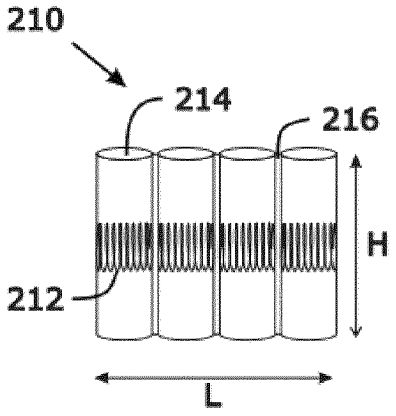
FIG. 2 shows an arrangement of a linear string of pocketed springs as can be used in the invention.

A first example of arrangement of the linear string of pocketed springs in the spool is shown in FIG. 2. For the sake of clarity of illustration, FIG. 2 shows the linear string 210 of pocketed spring in uncompressed condition. On the spool, the linear string and the pockets are compressed. The linear string 210 of pocketed springs comprises springs 212 each provided in a textile pocket 214. The springs are helically coiled steel wire springs. The textile pockets are assembled to each other in linear direction. The linear string has a width of one textile pocket. The pockets are made from spunbonded nonwoven fabric by means of welds, more preferably by means of thermal welds. A line of welds 216 is provided in between the textile pockets. The pockets have a height direction indicated by H in FIG. 2. The height direction of the pockets is the direction that will provide the thickness of the 2D-core made with the string of pocketed springs. The string has a length direction indicated by L in FIG. 2. The height direction of the pockets is perpendicular to the length direction of the string of pocketed springs. The springs are provided in the pockets such that the height direction of the helically coiled steel wire spring is perpendicular to the height direction of the pockets. At or after unwinding the string from the spool, the springs need to be turned over 90° such that the height direction of the springs coincide with the height direction of the pockets. Turning the springs can be done without difficulty by simple mechanical means.

Figure 3:
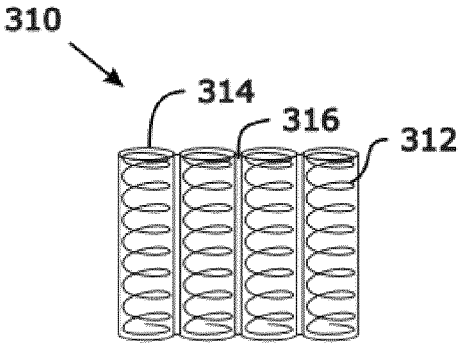
FIG. 3 shows another arrangement of a linear string of pocketed springs as can be used in the invention.

An alternative arrangement of the linear string of pocketed springs in the spool is shown in FIG. 3. For the sake of clarity of illustration, FIG. 3 shows the linear string 310 of pocketed spring in uncompressed condition. On the spool, the linear string and the pockets are compressed. The linear string 310 of pocketed springs comprises springs 312 each provided in a textile pocket 314. The springs are helically coiled steel wire springs. The textile pockets are assembled to each other in linear direction. The linear string has a width of one textile pocket. The pockets are made from spunbonded nonwoven fabric by means of welds, more preferably by means of thermal welds. A line of welds 316 is provided in between the textile pockets. The springs 312 are provided in the pockets 314 such that the height direction of the springs coincides with the height direction of the pockets. This is the orientation the springs have in two-dimensional pocketed spring cores.

Figure 4:
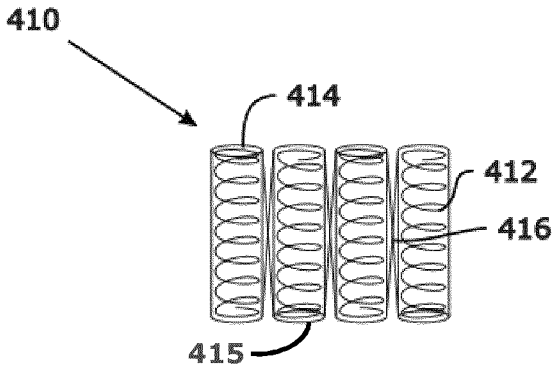
FIG. 4 shows another arrangement of a linear string of pocketed springs as can be used in the invention.

Another—particularly beneficial—arrangement of the linear string of pocketed springs in the spool is shown in FIG. 4. For the sake of clarity of illustration, FIG. 4 shows the linear string 410 of pocketed spring in uncompressed condition. On the spool, the linear string and the pockets are compressed. The linear string 410 of pocketed springs comprises springs 412 each provided in a textile pocket 414, 415. The springs are helically coiled steel wire springs. The textile pockets are assembled to each other in linear direction. The linear string has a width of one textile pocket. The pockets are made from spunbonded nonwoven fabric by means of welds, more preferably by means of thermal welds. A line of welds 416 is provided in between the textile pockets. The linear string of pocketed springs in the spool comprises pockets 414 in a first arrangement and pockets 415 in a second arrangement. The pockets in the second arrangement differ from the pockets of the first arrangement in that the pockets have been turned around the length direction of the string over 180° . This turning will bring along a compression of the pockets (however, FIG. 4 shows the pockets in uncompressed condition, for the sake of illustration of the arrangement of springs and pockets in the linear string). In the example of FIG. 4 pockets 414 according to the first arrangement alternate in the spool with pockets 415 of the second arrangement along the length of the linear string of pocketed springs. The transition in the string of pocketed springs from a pocket 414 of the first arrangement to a pocket 415 of the second arrangement can be easily noticed via the rotation at the connection 416 of the pockets: this connection has been turned over 180°. In FIG. 4, the springs are oriented in such way that the height direction of the spring coincides with the height direction of the pockets as in FIG. 3. However, it is also possible to orient the springs in the way as shown in FIG. 2.

Figure 5:
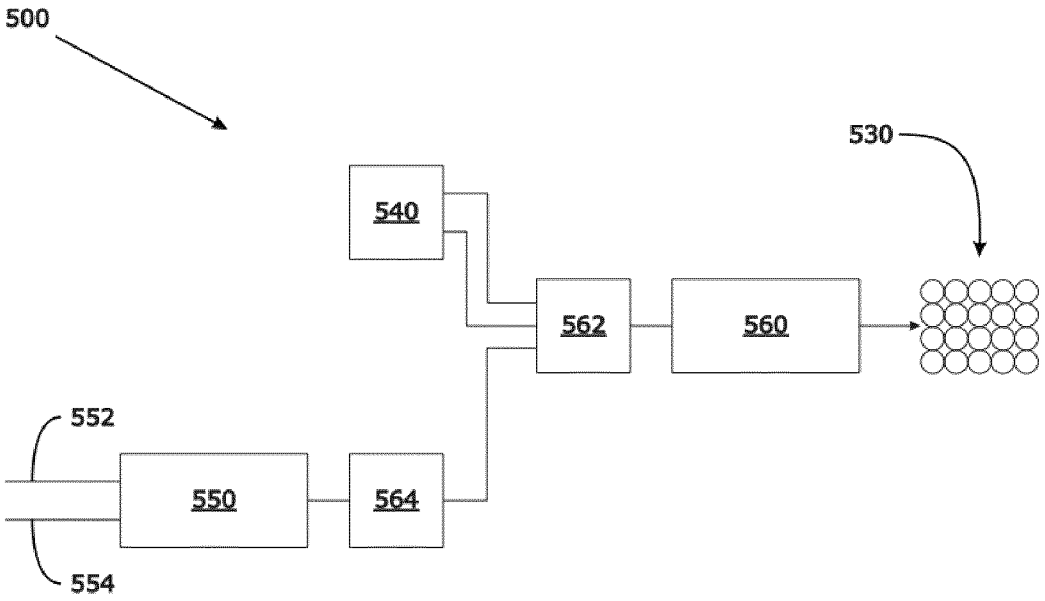
FIG. 5 shows an example of an apparatus according to the fifth aspect of the invention.

FIG. 5 shows in schematic representation an example of an apparatus 500 according to the fifth aspect of the invention. The apparatus 500 is provided for the assembly of a two-dimensional pocketed spring core 530 using linear strings of pocketed springs. The apparatus comprises a creel 540 comprising a plurality of pay-off stands, a machine 550 for manufacturing strings of pocketed springs; and an assembly station 560. Steel wire 552 and nonwoven fabric 554 are supplied to the machine 550 in order to manufacture strings of pocketed steel wire springs. The pay-off stands are each provided for holding a spool of a linear string of pocketed springs as in any embodiment of the first aspect of the invention. The assembly station is provided for assembling—in an otherwise known way—in the two-dimensional spring core lengths of strings of pocketed springs unwound from the spool(s) on the plurality of pay-off stands while allowing the pocketed springs to relax to their uncompressed state; and lengths of strings of pocketed springs produced inline by the one or plurality of machines. The apparatus can comprise a feeding device 562 for selecting and feeding the strings of pocketed springs—whether taken from the spools or produced in-line by the pocketed spring manufacturing machine to the assembly station. The apparatus can comprise a buffer 564, e.g. a bin, for temporarily buffering length of strings of pocketed springs produced by the pocketed spring manufacturing machine 550. This way, the machine can continuously manufacture pocketed springs. The apparatus can comprise a control unit for controlling the feeding of the strings of pocketed springs from the spools and/or from the pocketed spring manufacturing machine to the assembly station.

The invention claimed is:

1. A spool of a linear string of pocketed springs, wherein the linear string of pocketed springs comprises springs each provided in a textile pocket, wherein the springs comprise helically coiled steel wire springs;

wherein the textile pockets are assembled to each other in linear direction;

wherein the linear string has a width of one textile pocket;

wherein the string of pocketed springs is present in the spool spirally wound and in a compressed state such that the pocketed springs can expand upon unwinding the string of pocketed springs from the spool, wherein the linear string of pocketed springs is wound in alternating first and second layers over the width direction of the spool; and wherein the string of pocketed springs is wound in a first layer in a first width direction of the spool, and the string of pocketed springs is wound in a second layer in the direction opposite to the first width direction over the width of the spool.

2. The spool according to claim 1, wherein the linear string of pocketed springs is present as a plurality of layers in radial direction of the spool.

3. The spool according to claim 2, wherein successive layers of the linear string of pocketed springs make direct contact.

4. The spool according to claim 2, wherein an interlayer material is provided between the layers.

5. The spool according to claim 1, wherein, in longitudinal direction of the spool axis, a plurality of pockets are provided next to each other.

6. The spool according to claim 1, wherein the pockets have a height direction perpendicular to the length direction of the string of pocketed springs;

and wherein the springs are provided in the pockets such that the height direction of the helically coiled steel wire spring is perpendicular to the height direction of the pockets.

7. The spool according to claim 1, wherein the height direction of the pockets is provided in radial direction of the spool.

8. The spool according to claim 1, wherein the linear string of pocketed springs in the spool comprises pockets in a first arrangement and pockets in a second arrangement;

wherein the pockets in the second arrangement differ from the pockets of the first arrangement in that the pockets have been turned 180° in the length direction of the string.

9. The spool according to claim 1, wherein a fabric tape is glued on top of and/or at the bottom of the string of pocketed springs.

10. A method of manufacturing a two-dimensional pocketed spring core comprising the steps of providing the spool of a linear string of pocketed springs according to claim 1;

unwinding the linear string of pocketed springs from the spool and allowing the pocketed springs to relax to their uncompressed state; and assembling the linear string of pocketed springs into a two-dimensional pocketed spring core.

11. The method of manufacturing a two-dimensional pocketed spring core according to claim 10, comprising the steps of providing a plurality of spools of a linear string of pocketed springs according to claim 1;

unwinding the linear strings of pocketed springs from the spools and allowing the pocketed springs to relax to their uncompressed state; and assembling the linear strings of pocketed springs into a two-dimensional pocketed spring core.

12. The method of manufacturing a two-dimensional pocketed spring core according to claim 10, comprising the steps of providing one or a plurality of spools of a linear string of pocketed springs according to claim 1 providing one or a plurality of machines for manufacturing strings of pocketed springs;

unwinding linear string(s) from one or from more than one of the one or a plurality of spools allowing the pocketed springs to relax to their uncompressed state; and assembling into a two-dimensional spring core the unwound linear string(s) together with one or more strings of pocketed springs produced in-line with the assembly process on the one or a plurality of machines.

13. The method of manufacturing a two-dimensional pocketed spring core according to claim 10, wherein the pocketed springs of at least two of the plurality of spools of a linear string of pocketed springs differ in spring characteristics.

14. The method of manufacturing a two-dimensional pocketed spring core according to claim 10, wherein the method produces a two--dimensional pocketed spring core having zones with different spring characteristics.

* * * * *